US005261629A

United States Patent [19]

Becker et al.

[11] Patent Number: 5,261,629

[45] Date of Patent: Nov. 16, 1993

[54] FIN STABILIZED PROJECTILE

[75] Inventors: Wilfried Becker, Düsseldorf; Gerhard Glotz, Celle; Josef Osthues, Mettmann; Hans-Peter Opitz, Leimen; Heinz-Josef Kruse, Ratingen; Jutta Peters, Düsseldorf; Helmut Peller, Höhenkirchen, all of Fed. Rep. of Germany

[73] Assignee: Rheinmetall GmbH, Fed. Rep. of Germany

[21] Appl. No.: 861,416

[22] Filed: Apr. 2, 1992

Related U.S. Application Data

[63] Continuation-in-part of Ser. No. 505,274, Apr. 6, 1990, abandoned.

[30] Foreign Application Priority Data

Apr. 8, 1989 [DE] Fed. Rep. of Germany ..... 3911576

[51] Int. Cl.[5] ..... F42B 10/66

[52] U.S. Cl. ..... 244/3.22; 102/213; 102/473; 102/496; 244/3.16

[58] Field of Search ..... 102/213, 473, 475, 476, 102/491, 492, 494, 495, 496, 497; 244/3.1, 3.15, 3.16, 3.22

[56] References Cited

U.S. PATENT DOCUMENTS

| | | | |
|---|---|---|---|
| 3,000,307 | 9/1961 | Trotter, Jr. | 244/3.22 |
| 3,072,055 | 1/1963 | Ross | 244/3.16 |
| 3,282,540 | 11/1966 | Lipinski | 244/3.16 |
| 3,398,916 | 8/1968 | Van Vyve | 102/476 |
| 3,980,005 | 7/1976 | Rothman | 102/492 |
| 4,142,696 | 3/1979 | Nottingham | 244/3.16 |
| 4,492,166 | 1/1985 | Purcell | 244/3.22 |
| 4,519,315 | 5/1985 | Arszman | 102/377 |
| 4,533,094 | 8/1985 | Geis et al. | 244/3.22 |
| 4,568,040 | 2/1986 | Metz | 244/3.22 |
| 4,598,884 | 7/1986 | Speer | 244/3.16 |
| 4,823,700 | 4/1989 | Alker et al. | 102/476 |
| 4,858,531 | 8/1989 | Lindstadt et al. | 102/476 |
| 5,037,040 | 8/1991 | Goltz et al. | 244/3.22 |

FOREIGN PATENT DOCUMENTS

| | | | |
|---|---|---|---|
| 229541 | 7/1987 | European Pat. Off. . | |
| 3337873 | 4/1984 | Fed. Rep. of Germany . | |
| 3300709 | 7/1984 | Fed. Rep. of Germany . | |
| 3900442 | 7/1990 | Fed. Rep. of Germany | 102/496 |
| 2074186 | 12/1970 | France . | |

*Primary Examiner*—Harold Tudor

*Attorney, Agent, or Firm*—Spencer, Frank & Schneider

[57] ABSTRACT

A fin stabilized ballistic projectile comprises a projectile body having a plurality of stabilizing fins and an ejectable projectile tip detachably attached to the front of the projectile body. An ejection mechanism is operatively disposed for ejecting the projectile tip. A sensor is disposed in the projectile tip for scanning a target area. A warhead is disposed at the front of the projectile body behind the projectile tip and includes a curved fragmentation plate for discharging fragments at a target, with the fragmentation plate being openly exposed when the projectile tip is ejected, and an explosive charge disposed behind the fragmentation plate. A control unit is connected to the sensor for receiving the target signals and having outputs coupled to the ejection mechanism and the explosive charge, the control unit producing controls signals in dependence of the target signals for causing the ejection mechanism to eject the projectile tip and for subsequently detonating the explosive charge thereby causing the fragmentation plate to break up into fragments and discharging the fragments at high acceleration within an angle of revolution determined by the degree of curvature of the fragmentation plate.

7 Claims, 2 Drawing Sheets

FIN STABILIZED PROJECTILE

CROSS REFERENCE TO RELATED APPLICATION

This application is a continuation-in-part of U.S. application Ser. No. 07/505,274, filed Apr. 6, 1990, (now abandoned) the subject matter of which is incorporated herein by reference.

BACKGROUND OF THE INVENTION

This invention relates to a fin stabilized projectile, in particular, tank ammunition.

Known fin stabilized projectiles of this type are used as ballistic projectiles for attacking slow-flying air targets, such as helicopters. A drawback of the known projectiles is their low probability of a hit, given that after firing there is no provision for compensating for ballistic errors and target movements during flight.

In addition, guided projectiles are known that are directly aimed at a target under visual contact, and can be steered toward the target after firing. Both visual contact with the target and a connection between the control unit and a fire direction center in a vehicle, for example, are required for controlling such projectiles. Drawbacks of such guided projectiles include their costly control elements and their complex construction. Likewise high technical costs are necessary in automatic (autonomous) target-seeking projectiles; in particular, a search head with relatively wide-ranging scanning capabilities must be provided.

SUMMARY OF THE INVENTION

An object of the invention is to provide an improved, simply constructed fin stabilized projectile, and in particular tank ammunition for slow flying targets that exhibits a high hit probability.

This object and others to become apparent as the specification progresses, are accomplished by the invention, according to which there is provided a fin stabilized ballistic projectile, comprising: a projectile body having a plurality of stabilizing fins and a longitudinal axis; an ejectable projectile tip detachably attached to a front end of said projectile body; ejection means operatively disposed for ejecting the projectile tip; sensor means disposed in the projectile tip for scanning a target area and producing target signals representing a target recognized by the sensor means; a warhead disposed at the front end of the projectile body behind the projectile tip and including: a curved fragmentation plate for discharging fragments at a target, the fragmentation plate being openly exposed when the projectile tip is ejected; and an explosive charge disposed behind the fragmentation plate; and control means connected to the sensor means for receiving the target signals and having outputs coupled to the ejection means and the explosive charge, the control means producing controls signals in dependence of the target signals for causing the ejection means to eject the projectile tip and for subsequently detonating the explosive charge thereby causing the fragmentation plate to break up into fragments and discharging the fragments at high acceleration within an angle of revolution determined by the degree of curvature of the fragmentation plate.

A great advantage of the inventive fin stabilized projectile is that it combines the advantages of known armor piercing projectiles, such as large warheads, along with the advantages of guided missiles. This advantageous combination of the invention makes possible the compensation for ballistics errors and movements of the target, during the duration of flight of the projectile, without the need for a direct connection between the projectile and a guidance system in an armored vehicle.

In addition, the fin stabilized projectile according to the invention may be used for attacking hidden targets. In such cases, the projectile has, for example, an initiator which is activated at a predetermined sight angle over targets by means of a time-delay fuse or a distance fuse.

DETAILED DESCRIPTION OF THE PREFERRED EMBODIMENTS

Figure 1:
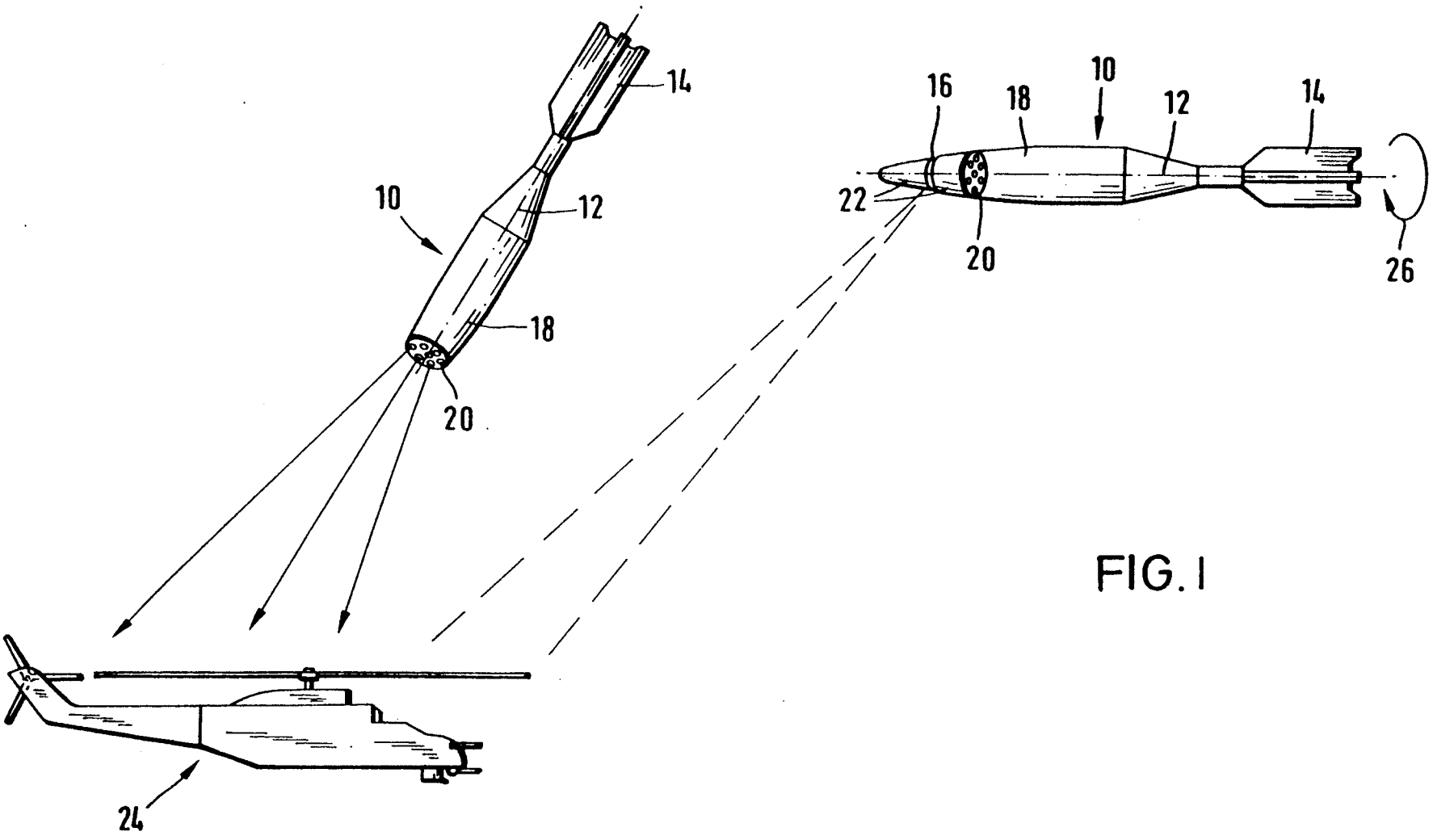
FIG. 1 is a schematic diagram which shows a preferred embodiment of the fin stabilized projectile of the present invention in flight.

On the right side of FIG. 1 a fin stabilized projectile 10 of the present invention is depicted durin flight in the vicinity of a target area. Projectile 10 has a longitudinal axis 12, is fin-stabilized by tail section fins 14, and has a projectile tip 22 in which a sensor unit 16 is located. Tail fins 14 are oriented at an angle $\alpha$ to longitudinal axis 12 such that projectile 10 executes a self-rotational movement as is well known in the art. Behind projectile tip 22 a warhead 18 is provided having a fragmentation plate 20. A fuse may be disposed in the tip for causing ejection of the tip and initializing the warhead in response to target detection by the sensor.

Sensor electronics (see FIG. 2) can be housed in any desired location in projectile 10. Sensor unit 16 performs the scanning of the target area, as shown by the sector defined by the dashed lines. Sensor unit 16 may include, for example, a single sensor, or likewise, a row or array of sensors.

The required rotation for scanning may be performed by a fixed sensor within sensor unit 16 that rotates with the entire projectile 10 about its longitudinal axis 12 as a result of the corresponding positioning of tail fins 14, or by sensor unit 16 being a rotatable sensor that executes a rotary motion relative to projectile 10.

As soon as a flying target, depicted as a helicopter 24, is detected by projectile 10, specifically by sensor unit 16, projectile 10 is rotated about its normal or vertical axis when projectile 10 is near target 24 in order to compensate for ballistics errors and target movements during the flight time of the projectile. The entire projectile tip 22 including sensor unit 16 is then blasted off or ejected, and warhead 18, in which fragmentation plate 20 is now directed at target 24, is initialized.

Guidance of projectile 10 can be facilitated by using a miniature propulsion drive or explosive charge means for guiding the projectile for directing the projectile at the target. Such a miniature propulsion or reaction drive is described in greater detail in assignee's copending U.S. application, Ser. No. 07/485,900, filed Mar. 1, 1990, entitled "FIN STABILIZED SUBAMMUNITION BODY," now U.S. Pat. No. 5,037,040, the disclosure of which is incorporated herein by reference.

To avoid the detection of false or decoy targets, path or time information may be transmitted from the fire direction center of an armored vehicle prior to the break-up of the weapon; i.e., prior to the blasting off of the projectile tip. For that purpose projectile 10 may be provided additionally with a sending and receiving apparatus having corresponding electronics, which are not more particularly shown in the drawing for the ease of understanding of the invention.

Figure 2:
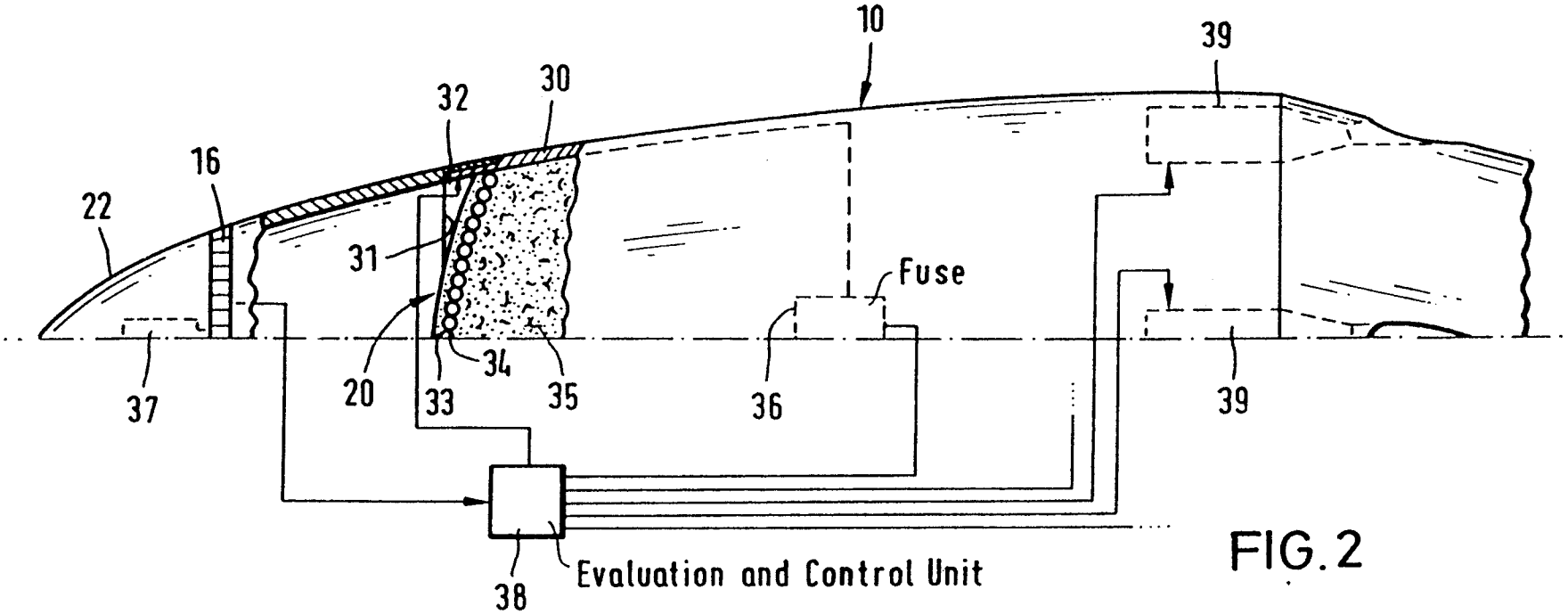
FIG. 2 is a partial sectional view of the fin stabilized projectile of FIG. 1 showing various components in greater detail.

FIG. 2 shows a partial and sectional view of the fin stabilized projectile from FIG. 1 and a schematic representation of the electronics. Projectile 10 has a projectile cover 30, which in the region of fragmentation plate 20 is connected with projectile tip 22. Projectile tip 22 is provided on its interior, adjacent to fragmentation plate 20, with a circumferential recess 31, which accommodates an annular explosive charge 32 with which projectile tip 22 can be blasted off projectile cover 30 in order to openly expose fragmentation plate 20.

Fragmentation plate 20 comprises a layer of metallic bullets 34 evenly embedded in an substrate 33, such as an insulating material or plastic matrix, such as described in German Offenlegungsschrift (unexamined published application) 3,900,442. Fragmentation plate 20 is curved toward the exterior with the degree of curvature determining an angle of revolution within which bullets 34 are discharged. Fragmentation plate 20 thus conceals an explosive charge 35 arranged behind it, which is accommodated by projectile cover 30 and which can be ignited by means of a fuse 36 that is initiated by a control signal from an evaluation and control unit 38. Ignition of explosive charge 35 results in a discharge of bullets 34 at very high acceleration within the angle of revolution which is predetermined by the curvature of fragmentation plate 20.

Sensor unit 16 in projectile tip 22 may, as is shown, comprise a plurality of sensors or it may comprise a single sensor or line of sensors extending substantially to the circumference of the projectile, which, if the projectile is not subjected to self rotation due to a lack of correspondingly adjusted fin tails 14, may be continually rotated by means of an electronic motor 37 in order to scan the target region. Signals of the individual sensors are transmitted to evaluation and control unit 38 for evaluation with respect to the presence of a target and production of the requisite control signals.

If evaluation and control unit 38 detects the presence of a target on the basis of incoming signals, one or a plurality, for example, of four propulsion mechanisms 39, evenly distributed within the interior circumference of the projectile, are ignited under the control of evaluation and control unit 38 in order to rotate the projectile about a vertical axis, that is an axis that is transverse to the longitudinal axis of the projectile. At the same time, fuse 36 is triggered by evaluation and control unit 38 in order to ignite explosive charge 35 upon reaching the direction of the target. In the rotated position of the projectile, explosive charge 32 is ignited as a result of evaluation and control unit 38. This causes the projectile tip 22 to be blasted off and the fragmentation plate to be exposed such that, as a result of the subsequent ignition of explosive charge 35, by way of fuse 36, bullets 34 bombard target 24.

It will be understood that the above description of the present invention is susceptible to various modifications, changes, and adaptations, and the same are intended to be comprehended within the meaning and range of equivalents of the appended claims.

What is claimed is:

1. A fin stabilized ballistic projectile, comprising:

a projectile body having a plurality of stabilizing fins and a longitudinal axis;

an ejectable projectile tip detachably attached to a front end of said projectile body;

ejection means operatively disposed for ejecting said projectile tip;

sensor means disposed in said projectile tip for scanning a target area and producing target signals representing a target recognized by said sensor means;

a warhead disposed at the front end of said projectile body behind said projectile tip and including:

a curved fragmentation plate for discharging fragments at a target, said fragmentation plate being openly exposed when said projectile tip is ejected; and an explosive charge disposed behind said fragmentation plate; and control means connected to said sensor means for receiving the target signals and having outputs coupled to said ejection means and said explosive charge, said control means producing controls signals in dependence of the target signals for causing said ejection means to eject said projectile tip and for subsequently detonating said explosive charge thereby causing said fragmentation plate to break up into fragments and discharging the fragments at high acceleration within an angle of revolution determined by the degree of curvature of said fragmentation plate.

2. A projectile according to claim 1, and further including a fuse having an input connected to an output of said control means for receiving a control signal and having an output connected to said explosive charge for igniting said explosive charge in response to the control signal at said input.

3. A projectile according to claim 1, wherein said plurality of stabilizing fins are shaped to cause rotation of said projectile body about its longitudinal axis during flight and said sensor means is fixed with respect to said projectile body and rotates therewith for scanning a target area.

4. A projectile according to claim 1, wherein said sensor means is rotatably attached to said projectile body, and said device further includes drive means for rotating said sensor means.

5. A projectile according to claim 1, further comprising propulsion drive means disposed within said projectile body and having an input connected to an output of said control means for receiving a control signal, said control means producing a control signal in response to target signals for initiating said propulsion drive means for causing rotation of said projectile body about an axis transverse to the longitudinal axis of said projectile body toward a target sensed by said sensor means.

6. A projectile according to claim 1, wherein said ejection means comprises a further explosive charge disposed between said projectile tip and s id projectile body and connected to said control means for receiving a control signal in response to target signals for exploding said further explosive charge to thereby eject said projectile tip from said projectile body.

7. A projectile according to claim 1, wherein said fragmentation plate comprises a substrate and a layer of individual bullets embedded in said substrate.

* * * * *